United States Patent [19]

Iijima

[11] Patent Number: 4,487,038

[45] Date of Patent: Dec. 11, 1984

[54] LAMINATE TYPE EVAPORATOR

[75] Inventor: Takeo Iijima, Konan, Japan

[73] Assignee: Diesel Kiki Co., Ltd., Tokyo, Japan

[21] Appl. No.: 487,505

[22] Filed: Apr. 22, 1983

[30] Foreign Application Priority Data

Apr. 24, 1982 [JP] Japan ..... 57-59812[U]

[51] Int. Cl.[3] ..... F25B 39/02

[52] U.S. Cl. ..... 62/515; 165/166

[58] Field of Search ..... 62/515; 165/166

[56] References Cited

U.S. PATENT DOCUMENTS

| | | | |
|---|---|---|---|
| 3,030,782 | 4/1962 | Karmazin | 62/515 |
| 4,244,194 | 1/1981 | Haesters et al. | 62/515 |
| 4,370,868 | 2/1983 | Kim et al. | 62/515 |

*Primary Examiner*—Ronald C. Capossela

*Attorney, Agent, or Firm*—Frishauf, Holtz, Goodman & Woodward

[57] ABSTRACT

In an evaporator composed of a plurality of hollow bodies defining therein tanks at opposite ends and refrigerant passages intermediate therebetween, and a plurality of fins, the hollow bodies and the fins being alternately superposed, refrigerant inlet and outlet pipes are interposed between at least one of the hollow bodies at the opposite sides of the evaporator and at least one end plate attached thereto, and held in a predetermined position by locating projections formed on the end plate. The inlet and outlet pipes are each formed of a pair of semitubular members joined together in an abutting manner. The pipes are brazed together with the hollow bodies, fins, and end plates, in a furnace.

20 Claims, 7 Drawing Figures

LAMINATE TYPE EVAPORATOR

BACKGROUND OF THE INVENTION

This invention relates to laminate type evaporators for use in air conditioning systems, and more particularly to improvements in or to refrigerant inlet and output pipes of an evaporator of this kind and fitting means therefor.

A laminate type evaporator for air conditioning systems for automotive vehicles generally has a laminated or superposed structure comprising a plurality of flat hollow bodies each composed of two stamped plates, each of which has opposite end tank-forming portions and an intermediate passage-forming portion, the two stamped plates being joined together in an abutting manner, wherein the tank-forming portions of the joined plates define tanks at opposite ends, and the passage-forming portions an intermediate passage, respectively, a plurality of fins, typically corrugated, the hollow bodies and the fins being superposed one upon another in an alternate manner, and a pair of end plates attached to outermost ones of the hollow bodies on the opposite sides.

To manufacture such evaporator, a semi-built-up assembly of component parts, held together by a suitable jig is charged into a furnace, and heated therein, whereby a brazing material previously applied or clad over the stamped plates and the corrugated fins is melt to unite the component parts together.

On this occasion, a refrigerant inlet pipe and a refrigerant outlet pipe, which are interposed between the tanks and one of the end plates, are also united with the other components by brazing in the furnace. Conventionally, such inlet and outlet pipes are formed of cold forged pipes having rectangular cross sections, and therefore have the following disadvantages:

(1) First, since they are manufactured by cold forging, they are rather expensive;

(2) They show a low yield in the furnace brazing;

(3) The stamped plates and the end plate, arranged at the opposite sides of the inlet and outlet pipes which are cold forged, are required to have rigidity sufficient to retain the pipes in place. Therefore, they need to have increased thicknesses, resulting in increased production costs.

(4) The inlet and outlet pipes are difficult to locate in place, providing a problem of dislocation from their proper places during their manufacture.

SUMMARY OF THE INVENTION

It is the object of the invention to provide a laminate type evaporator in which the inlet pipes and outlet pipes are each formed of a pair of semitubular members joined together in an abutting manner, and the associated end plate is formed with locating projections positively retaining the inlet pipes and outlet pipes in place, and which show a high yield in the manufacture and low in cost.

According to the present invention, at least one of the end plates attached to the outermost ones of the hollow bodies has locating projections projected toward the hollow bodies, with refrigerant inlet pipe means and refrigerant outlet pipe means interposed between the at least one end plate and the corresponding one outermost hollow body. The pipe means each comprise a pair of semitubular members abutting against each other and joined together. The pipe means are retained in place by means of the above locating projections, and joined together by means of furnace brazing.

The above and other objects, features and advantages of the invention will be more apparent from the ensuing detailed description taken in conjunction with the accompanying drawings.

DETAILED DESCRIPTION

The evaporator according to the invention will now be described in detail with reference to the drawings showing a preferred embodiment thereof.

Figure 1:
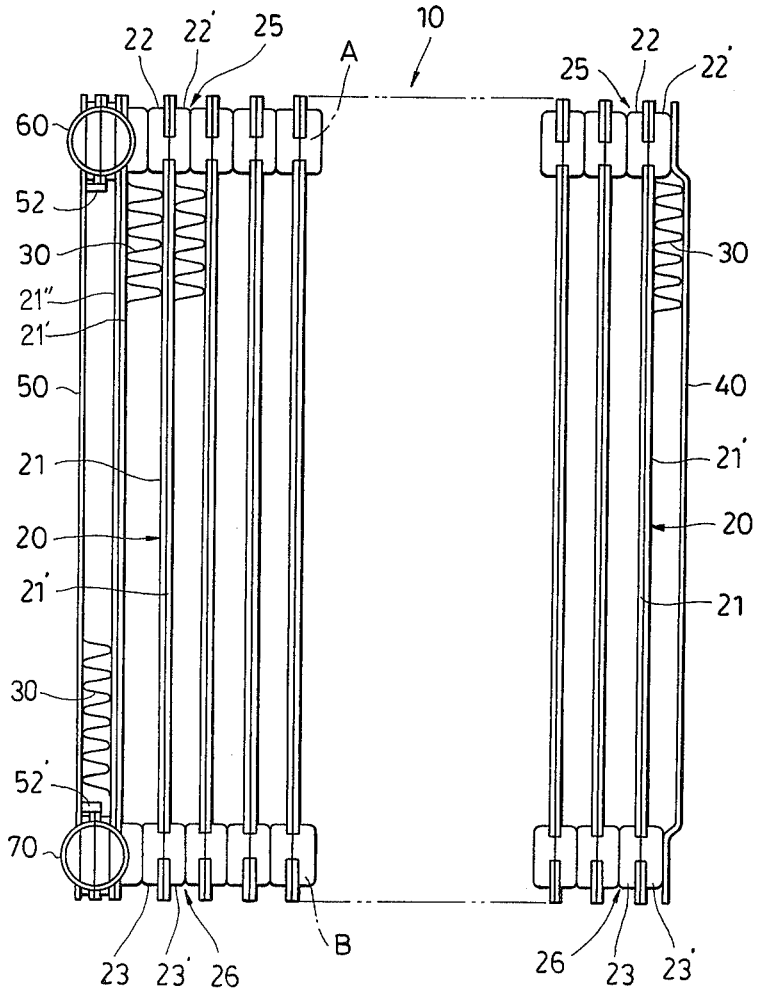
FIG. 1 is a schematic front view illustrating a laminate type evaporator according to an embodiment of the invention.
Figure 2:
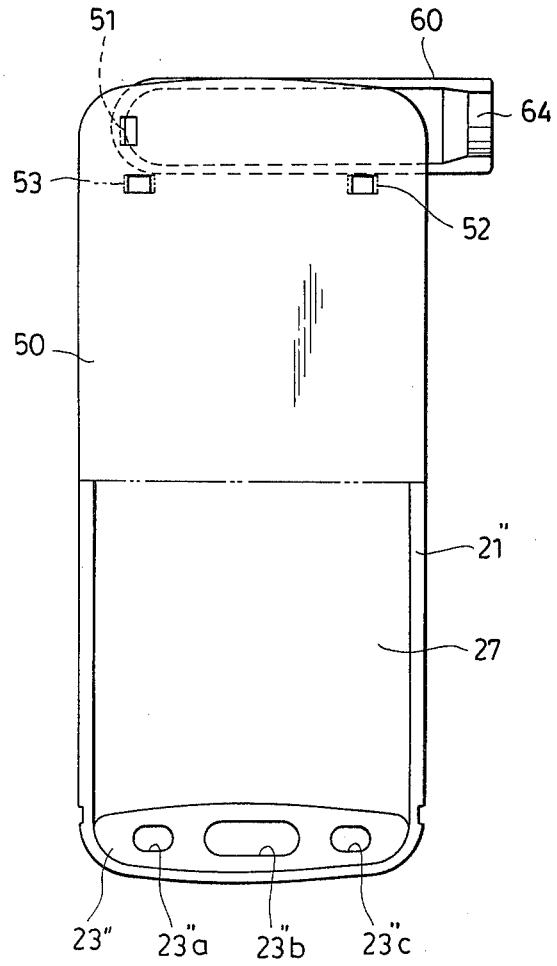
FIG. 2 is a schematic side view illustrating the evaporator of FIG. 1, showing an end plate at an upper half portion thereof, and a stamped plate at a lower half portion thereof.
Figure 3:
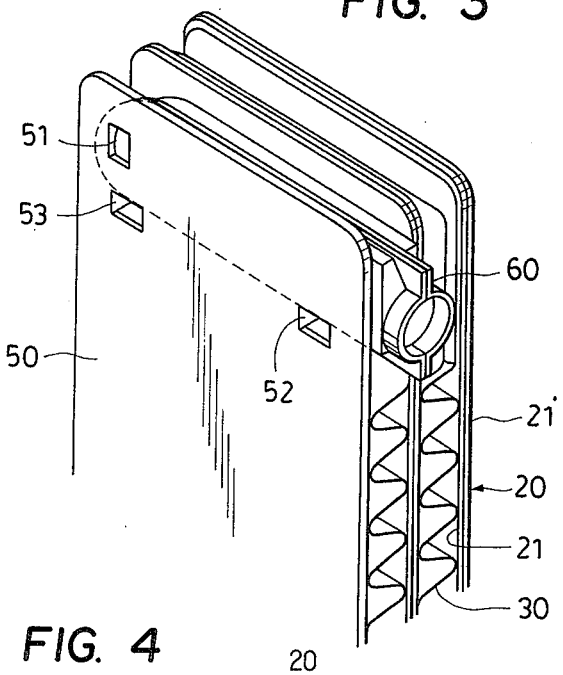
FIG. 3 is a schematic fragmentary perspective view illustrating part of the evaporator of FIG. 1.
Figure 4:
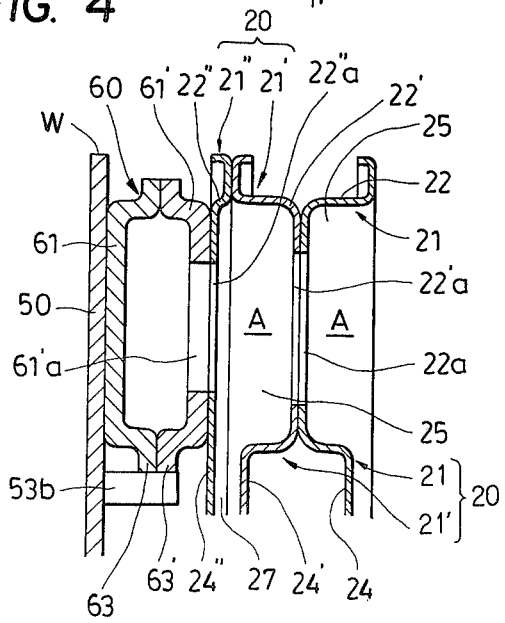
FIG. 4 is a fragmentary front view illustrating the outlet pipe and its peripheral parts in FIG. 1.

Referring first to FIGS. 1 through 4, reference numeral 10 designates a laminated structure of the evaporator, which includes a plurality of hollow bodies 20 each formed of two stamped plates 21 and 21' abutting against each other and joined together, each of which has tank forming portions 22, 22' and 23, 23' at opposite ends and an intermediate passage forming portion 24, 24' extending between the tank forming portions 22, 23. A plurality of corrugated fins 30 are interposed between adjacent ones of the hollow bodies 20, that is, the corrugated fins 30 and the hollow bodies 20 are alternately superposed one upon another to form the laminated structure 10. At upper and lower end portions of each of the hollow bodies 20, the tank forming portions 22, 22' of the stamped plates 21, 21' are joined together to define an upper tank 25 therebetween, and the tank forming portions 23, 23' are joined together to define a lower tank 26 therebetween. At an intermediate portion of the hollow body 20, the passage forming portions 24, 24' of the stamped plates 21, 21' are joined together to define therebetween a multiplicity of passages 27 communicating with the opposite tanks 25, 26 with each other. Each of the tank forming portions 22–23' is formed therein with two through holes (two of which are shown by numerals 22*a* and 22'*a* in FIG. 4), which communicate the adjacent upper tanks 25, 25 with each other and also communicate the adjacent lower tanks 26, 26 with each other. Defined within the superposed hollow bodies 20 constructed as above are a refrigerant outlet chamber A extending through all the upper tanks 25 and a refrigerant inlet chamber B extending through all the lower tanks 26. The both chambers A and B communicate with each other by way of the passages 27 formed in intermediate portions of the hollow bodies. An end plate 40 is secured by brazing to one side of the laminated structure 10, and another end plate 50 to the opposite side of same, respectively, with a refrigerant inlet pipe 60 and a refrigerant outlet pipe 70 interposed between the end plate 50 and the outermost stamped plate 21'' at the opposite side of the laminated structure, to form the evaporator. As shown in FIG. 4, the stamped plate 21'' opposite the end plate 50 has a different shape from the other stamped plates 21, 21', that is, its opposite end tank forming portions (one of which is shown and designated by reference numeral 22'') have side surfaces flush with the passage forming portion 24''.

Figure 5:
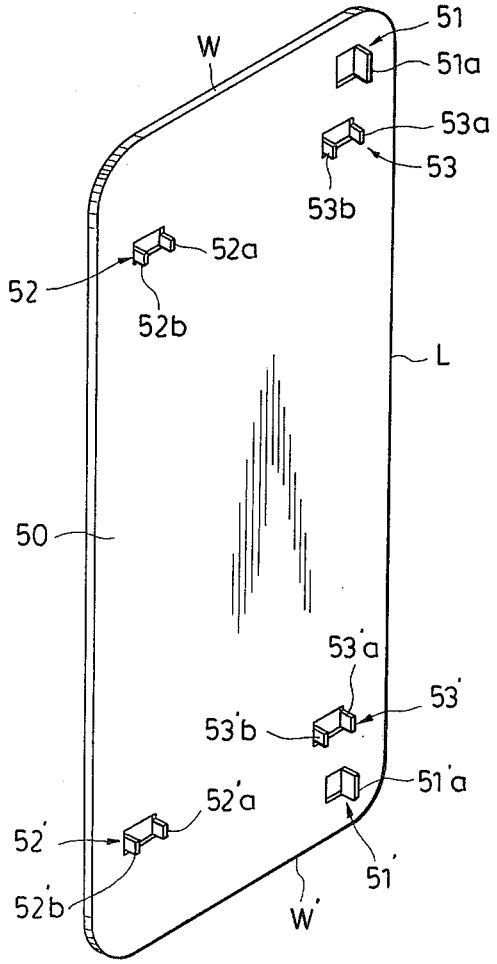
FIG. 5 is a schematic perspective view illustrating the end plate in FIG. 1.

As most clearly shown in FIG. 5, the end plate 50 is formed with three locating projections 51–53 or 51'–53' at each of the opposite end portions, for locating and retaining the respective inlet and outlet pipes 60, 70 in place. In the illustrated embodiment, these locating projections are formed by making cuts in the wall of a plate member to be formed into the end plate 50 and raising the cuts. Of these locating projections into lugs, the locating projections 51, 51' are located at the upper and lower end portions of the end plate 50 and in the vicinity of the opposite longitudinal rear egdes L of same. The locating projections 51, 51' each have one lug 51*a*, 51'*a* projected toward the stamped plate 21'' through at least such a distance as it can be in face-to-face contact with the end surface of a thickened portion of the corresponding semitubular member, hereinafter referred to, of the inlet pipe or outlet pipe 60, 70 at an end remote from the open end 62, 62'. The other paired locating projections 52 and 53 or 52' and 53', as shown in FIGS. 4 and 5, are located at a predetermined distance from the corresponding transverse edge W, W' of the end plate 50, which is substantially equal to the height of the inlet pipe or outlet pipe 60, 70, that is, the paired projections 52 and 53 or 52' and 53' are located on a line extending parallel with the edge W, W'. Further, the locating projections in each pair, i.e. 52 and 53 or 52' and 53' are spaced from each other in the transverse direction. In the illustrated embodiment, each of the locating projections 52–53' is formed by two lugs 52*a*, 52*b*–53'*a*, 53'*b* formed of cuts in the wall of the end plate 50 and projected toward the stamped plate 21''. The distance through which each of the locating projections 52–53' is projected is set at such a value as it can have one side edge disposed in contact with end surfaces of the joining peripheral flanges, hereinafter referred to, of the semitubular members of the corresponding inlet or outlet pipe 60, 70. For instance, as shown in FIG. 4, the lug 53*b* has such a length that its upper side edge diposed in supporting contact with the lower end surfaces of the joining peripheral flanges 63, 63' of the outlet pipe 60.

Figure 6:
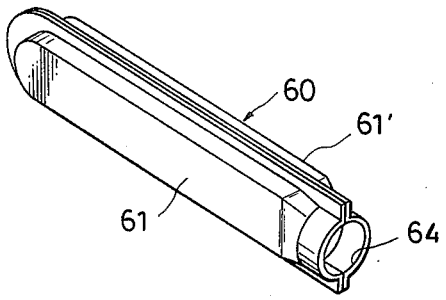
FIG. 6 is a schematic perspective view illustrating the outlet pipe in FIG. 1.
Figure 7:
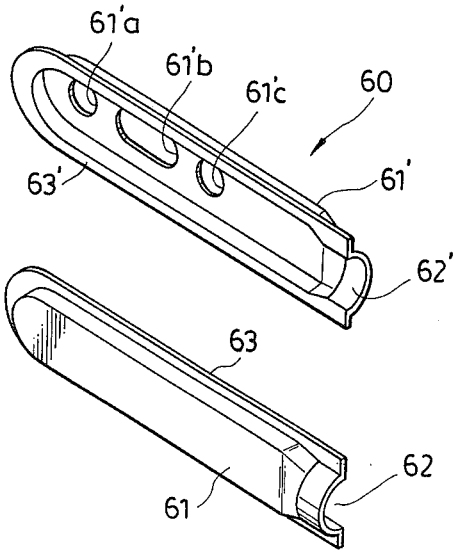
FIG. 7 is an exploded perspective view illustrating the outlet pipe of FIG. 6.

The refrigerant outlet pipe 60 and the refrigerant inlet pipe 70 are identical in construction, and therefore, the latter alone will now be explained. The refrigerant outlet pipe 60 is formed by two semitubular members 61 and 61' which are joined together in an abutting manner, as shown in FIGS. 6 and 7. Each of the semitubular members 61, 61' has such a configuration as corresponds to a half of a tube having a rectangular cross section obtained by longitudinally cutting the tube into two halves. The semitubular members, which have a thickness slightly larger than that of the stamped plates 21–21'', are substantially symmetrical with each other with respect to their joining surfaces and each have a generally U-shaped cross section, defining an open end forming portion 62, 62' at an end, and a joining peripheral flange 63, 63' extending from the same portion 62, 62' along the whole periphery and projected radially outward.

In the outlet pipe 60, as shown in FIGS. 1 through 4, the semitubular members 61, 61' are joined together along their joining peripheral flanges abutting against each other, and one component member 61 is disposed such that the outer side surface is in face-to-face contact with the opposed inner side surface of an upper end portion of the end plate 50, the peripheral surface of an end portion of the member 61 remote from the open end 64 in face-to-face contact with the locating projection 51 on the end plate 50, and the lower end surface of the joining peripheral flange 63 in contact with the upper surfaces of the projections 52, 53 of the end plate 50, respectively. The other semitubular member 61' is disposed such that the lower end surface of the joining peripheral flange 63 is in contact with the upper end surfaces of the locating projections 52, 53, and the outer side surface in face-to-face contact with the opposed side surface of the tank forming portion 22'' of the stamped plate 21'', respectively.

These semitubular members 61, 61' are preferably each made of a sheet member which has a brazing material clad over its side surfaces and stamped.

As shown in FIG. 7, the inner semitubular member 61' of the outlet pipe 60 has through holes 61'*a*, 61'*b* and 61'*c* at locations corresponding to three through holes formed in the upper tank forming portion 22'' of the outermost stamped plate 21'' (only one through hole 22''*a* of them is shown in FIG. 4). The three through holes formed in the upper tank forming portion 22'' of the stamped plate 21'' positionally correspond, respectively, to three through holes 23''*a*– 23''*c*, shown in FIG. 2, formed in the lower tank forming portion 23'' of the same plate 21'' and communicating the interior of the inlet pipe 70 with the interior of the lower tank 26.

As shown in FIG. 4, the outlet pipe 60 formed of two joined semitubular members 61, 61' has a rectangular cross section but its thickness, that is, the size of the shorter side of the rectangular cross section is the same as the thickness of the fin 30 interposed between the end plate 50 and the outermost stamped plate 21'', and its height, that is, the size of the longer side of the rectangular cross section is substantially the same as the height of the tank 25. As shown in FIGS. 6 and 7, the open end forming portions 62, 62'' of the semitubular members 61, 61' of the outlet pipe 60 are so configurated that the open end 64 of the outlet pipe 60 is formed with a cylindrical connection port 64 into which an end of a union joint, not shown, is to be fitted, to connect the evaporator to the refrigerating circuit, not shown.

To assemble the evaporator constructed as above, each pair 30 of stamped plates 21 and 21' or 21' and 21'' abutting against each other and the fins 30 are superposed in an alternate manner. Then, two pairs of the semitubular members of the inlet and outlet pipes 60, 70 are put into respective predetermined locations and retained therein by means of the locating projections 51–53' of the end plate 50, between the end plate 50 and the outermost stamped plate 21'' at the respective tank forming portions 22'', 23''. Further, two of the fins 30 are interposed between the end plates 40, 50 and the outermost stamped plates 21', 21'', respectively. The laminated structure 10 thus assembled is held in an assembled state by means of a jig, not shown, and charged into a furnace, not shown. The assembled laminated structure 10 is heated within the furnace so that the brazing material clad over the inner and outer surfaces of the stamped plates 21, 21' and 21'' melts to join the stamped plates 21, 21' and 21'' together into integral hollow bodies 20 and also join these hollow bodies 20 with the fins 30. At the same time, the brazing material clad over the inner and outer surfaces of the semitubular members also melts to join the semitubular members in each pair together to form the outlet pipe 60 and the inlet pipe 70. Further, the outermost stamped plate 21'' and the end plate 50 are also joined together in the same manner, at the same time. In this manner, an evaporator having an integral body is obtained.

As noted above, the semitubular members in each pair are joined together by furnace brazing to form the inlet pipe 60 and the outlet pipe 70, simultaneously with the brazing of the other component parts of the evaporator. After the furnace brazing is over, the union joints are screwed or force fitted into the connection ports such as 64 of the inlet pipe 60 and outlet pipe 70.

As noted above, the inlet and outlet pipes 60, 70 are positively and accurately located in respective predetermined places by means of the locating projections, without the possibility that the through holes communicating the tanks with the inlet and outlet pipes become out of alignment during the manufacture, resulting in an improved yield and a reduced cost in the manufacture of the laminate type evaporator.

The number of the locating projections 51–53' is not limited to three for each of the inlet and outlet pipes 60, 70 as in the illustrated embodiment, but it may be selected at any other suitable number such as four or two.

Obviously many modifications and variations of the present invention are possible in the light of the above disclosure. It is therefore to be understood that within the scope of the appended claims the invention may be practiced otherwise than as specifically described.

What is claimed is:

1. A laminate type evaporator comprising:

a plurality of hollow bodies, each having a pair of stamped plates abutting against each other and joined together, and defining two tanks therein at opposite end portions thereof and a multiplicity of passages therein at an intermediate portion thereof, said passages communicating the interiors of said tanks with each other, said tanks of adjacent ones of said hollow bodies at each of said opposite end portions thereof communicating with each other;

a plurality of fins, said hollow bodies and said fins bein alternately superposed;

a pair of end plates attached to opposite outermost ones of said hollow bodies, at least one of said end plates having a plurality of locating projections projected toward a corresponding one of said opposite outermost hollow bodies; and first and second pipe means interposed between said at least one end plate and said corresponding one outermost hollow body, for introducing refrigerant into said evaporator and discharging refrigerant therefrom, respectively, said first and second pipe means each comprising a pair of semitubular members abutting against each other and joined together, said first and second pipe means being retained in respective predetermined locations by said locating projections;

said hollow bodies, said fins and said first and second pipe means being brazed together to form an integral body.

2. A laminate type evaporator as claimed in claim 1, wherein said first and second pipe means each have a rectangular cross section, one side of which extends in a direction in which said hollow bodies and said fins are superposed, through a distance substantially equal to the thickness of one of said fins interposed between said at least one end plate and said corresponding one outer most hollow body.

3. A laminate type evaporator as claimed in claim 2, wherein said at least one end plate has opposite end portions and an inner side surface, said corresponding one outermost hollow body having a side surface facing toward said at least one end plate, one of said pair of semitubular members of each of said first and second pipe means having an outer side surface thereof disposed in face-to-face contact with said inner side surface of said at least one end plate at a corresponding one of said opposite end portions thereof, the other having an outer side surface thereof disposed in face-to-face contact with said side surface of said corresponding one outermost hollow body.

4. A laminate type evaporator as claimed in claim 3, wherein said pair of semitubular members of each of said first and second pipe means each have a joining peripheral flange extending along a substantially whole peripheral thereof and projected radially outward, said semitubular members having said joining peripheral flanges thereof abutting against each other and joined together along said joining peripheral flanges thereof.

5. A laminate type evaporator as claimed in claim 3, wherein said joining peripheral flange of each of said pair of semitubular members has an outer end surface, said locating projections of said at least one end plate includes projections disposed in contact with said outer end surfaces of said joining peripheral flanges of said pair of semitubular members.

6. A laminate type evaporator as claimed in claim 3, wherein said hollow bodies each have a first through hole opening in said tank defined therein, said other semitubular member having a second through hole aligned with said first through hole.

7. A laminate type evaporator as claimed in claim 1 wherein said at least one end plate has opposite end portions and an inner side surface, said corresponding one outermost hollow body having a side surface facing toward said at least one end plate, one of said pair of semitubular members of each of said first and second pipe means having an outer side surface thereof disposed in face-to-face contact with said inner side surface of said at least one end plate at a corresponding one of said opposite end portions thereof, the other having an outer side surface thereof disposed in face-to-face contact with said side surface of said coresponding one outermost hollow body.

8. A laminate type evaporator as claimed in claim 7, wherein said pair of semitubular members of each of said first and second pipe means each having a joining peripheral flange extending along a substantially whole peripheral thereof and projected radially outward, said semitubular members having said joining peripheral flanges thereof abutting against each other and joined together along said joining peripheral flanges thereof.

9. A laminate type evaporator as claimed in claim 7, wherein said joining peripheral flange of each of said pair of semitubular members has an outer end surface, said locating projections of said at least one end plate includes projections disposed in contact with said outer end surfaces of said joining peripheral flanges of said pair of semitubular members.

10. A laminate type evaporator as claimed in claim 7, wherein said hollow bodies each have a first through hole opening in said tank defined therein, said other semitubular member having a second through hole aligned with said first through hole.

11. A laminate type evaporator as claimed in claim 1, wherein said locating projections comprise at least one lug formed by at least one raised cut in said at least one end plate.

12. A laminate type evaporator as claimed in claim 1, wherein said end plates are brazed together with said hollow bodies, said fins and said first and second pipe means to form said integral body.

13. A laminate type evaporator as claimed in claim 12, wherein said first and second pipe means each have a rectangular cross section, one side of which extends in a direction in which said hollow bodies and said fins are superposed, through a distance substantially equal to the thickness of one of said fins interposed between said at least one end plate and said corresponding one outermost hollow body.

14. A laminate type evaporator as claimed in claim 13, wherein said at least one end plate has opposite end portions and an inner side surface, said corresponding one outermost hollow body having a side surface facing toward said at least one end plate, one of said pair of semitubular members of each of said first and second pipe means having an outer side surface thereof disposed in face-to-face contact with said inner side surface of said at least one end plate at a corresponding one of said opposite end portions thereof, the other having an outer side surface thereof disposed in face-to-face contact with said side surface of said corresponding one outermost hollow body.

15. A laminate type evaporator as claimed in claim 14, wherein said pair of semitubular members of each of said first and second pipe means each have a joining peripheral flange extending along a substantially whole peripheral thereof and projected radially outward, said semitubular members having said joining peripheral flanges thereof abutting against each other and joined together along said joining peripheral flanges thereof.

16. A laminate type evaporator as claimed in claim 14, wherein said joining peripheral flange of each of said pair of semitubular members has an outer end surface, said locating projections of said at least one end plate includes projections disposed in contact with said outer end surfaces of said joining peripheral flanges of said pair of semitubular members.

17. A laminate type evaporator as claimed in claim 14, wherein said hollow bodies each have a first through hole opening in said tank defined therein, said other semitubular member having a second through hole aligned with said first through hole.

18. A laminate type evaporator as claimed in claim 12, wherein said at least one end plate has opposite end portions and an inner side surface, said corresponding one outermost hollow body having a side surface facing toward said at least one end plate, one of said pair of semitubular members of each of said first and second pipe means having an outer side surface thereof disposed in face-to-face contact with said inner side surface of said at least one end plate at a corresponding one of said opposite end portions thereof, the other having an outer side surface thereof disposed in face-to-face contact with said side surface of said corresponding one outermost hollow body.

19. A laminate type evaporator as claimed in claim 18, wherein said pair of semitubular members of each of said first and second pipe means each have a joining peripheral flange extending along a substantially whole peripheral thereof and projected radially outward, said semitubular members having said joining peripheral flanges thereof abutting against each other and joined together along said joining peripheral flanges thereof.

20. A laminate type evaporator as claimed in claim 12, wherein said locating projections comprise at least one lug formed by at least one raised cut in said at least one end plate.

* * * * *